US010582763B1

(12) United States Patent
Villarreal

(10) Patent No.: US 10,582,763 B1
(45) Date of Patent: Mar. 10, 2020

(54) HAIR BRUSH

(71) Applicant: Thelma Villarreal, Corpus Christi, TX (US)

(72) Inventor: Thelma Villarreal, Corpus Christi, TX (US)

( * ) Notice: Subject to any disclaimer, the term of this patent is extended or adjusted under 35 U.S.C. 154(b) by 441 days.

(21) Appl. No.: 15/397,811

(22) Filed: Jan. 4, 2017

(51) Int. Cl.

| | |
|---|---|
| ***A45D 24/00*** | (2006.01) |
| ***A46B 11/00*** | (2006.01) |
| ***A46B 9/02*** | (2006.01) |
| ***A46B 15/00*** | (2006.01) |
| ***A45D 20/00*** | (2006.01) |

(52) U.S. Cl.
CPC ..... *A46B 11/0006* (2013.01); *A45D 20/00* (2013.01); *A46B 9/023* (2013.01); *A46B 15/0004* (2013.01); *A46B 15/0036* (2013.01); *A46B 15/0077* (2013.01); *A46B 15/0097* (2013.01)

(58) Field of Classification Search
CPC . A46B 11/0006; A46B 9/023; A46B 15/0004; A46B 15/0036; A46B 15/0077; A46B 15/0097; A46B 11/001; A46B 11/002; A46B 11/0062; A46B 11/0051; A45D 20/00; A45D 20/48; A45D 20/50; A45D 20/52; A45D 24/28; A45D 24/22
See application file for complete search history.

(56) References Cited

U.S. PATENT DOCUMENTS

| | | | | |
|---|---|---|---|---|
| 1,094,493 A | | 4/1914 | Taber | |
| 3,721,250 A | * | 3/1973 | Walter | A45D 20/50 132/112 |
| 5,261,427 A | * | 11/1993 | Dolev | A01K 13/002 119/664 |
| 5,622,192 A | * | 4/1997 | Chiou | A46B 11/0058 132/112 |
| 5,927,290 A | * | 7/1999 | Thiruppathi | A46B 11/0017 132/116 |
| 6,257,246 B1 | | 7/2001 | Kan | |
| 6,672,313 B2 | | 1/2004 | Battaglia | |
| 7,011,468 B1 | | 3/2006 | Leventhal | |
| 7,055,528 B2 | * | 6/2006 | Shah | A45D 19/02 132/109 |
| 7,063,090 B2 | * | 6/2006 | Wang | A45D 24/28 132/119.1 |
| D560,365 S | | 1/2008 | Huller | |
| 7,814,917 B2 | * | 10/2010 | Hurwitz | A01K 13/002 132/112 |

(Continued)

FOREIGN PATENT DOCUMENTS

WO 2001000057 A1 1/2001

*Primary Examiner* — Nicholas D Lucchesi

(57) ABSTRACT

The hair brush includes a removable handle that provides a secret compartment therein. The hair brush is also further defined with a brush head that is of hollowed construction, and includes componentry to provide accelerated air or a mist. The brush head interfaces with the handle to enable the device to be handheld. The brush head is further defined with a rear surface on which a mirrored surface is provided. A plurality of lights encircles the mirrored surface so as to illuminate an end user when viewing the mirrored surface. The brush head is further defined with a front surface from which a plurality of brush bristles extend. The plurality of brush bristles is adapted to interface with hair.

20 Claims, 5 Drawing Sheets

(56) References Cited

U.S. PATENT DOCUMENTS

| | | | | |
|---|---|---|---|---|
| 8,720,078 | B1 * | 5/2014 | Behbehani | A45D 20/12<br>34/97 |
| 10,194,740 | B2 * | 2/2019 | Velasquez | A46B 11/0006 |
| 10,271,627 | B1 * | 4/2019 | Calvo | A45D 24/22 |
| 2007/0157942 | A1 * | 7/2007 | Adkins | A45D 19/02<br>132/112 |
| 2008/0210251 | A1 * | 9/2008 | Dallianis | A45D 24/26<br>132/116 |
| 2017/0027301 | A1 * | 2/2017 | Mazed | A61K 8/97 |

* cited by examiner

HAIR BRUSH

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of hair brushes and accessories, more specifically, a hair brush that integrates other hair-treating technologies therein.

SUMMARY OF INVENTION

The hair brush includes a removable handle that provides a secret compartment therein. The hair brush is also further defined with a brush head that is of hollowed construction, and includes componentry to provide accelerated air or a mist. The brush head interfaces with the handle to enable the device to be handheld. The brush head is further defined with a rear surface on which a mirrored surface is provided. A plurality of lights encircles the mirrored surface so as to illuminate an end user when viewing the mirrored surface. The brush head is further defined with a front surface from which a plurality of brush bristles extend. The plurality of brush bristles is adapted to interface with hair. The brush head includes an air dryer component that places a plurality of air nozzles on the front surface such that accelerated air is propelled away from the front surface in order to dry hair that is being brushed via the plurality of brush bristles. The brush head is further defined with a plurality of mist bristles that extend from the font surface. The plurality of mist bristles is in fluid connection with a fluid reservoir that may be filled with an aqueous solution or hair-detangling solution. The plurality of mist bristles extends a mist length, which is less than the length of the plurality of brush bristles. The plurality of mist bristles is configured to deliver the aqueous solution directly onto the hair whilst said hair is being brushed via the plurality of brush bristles.

These together with additional objects, features and advantages of the hair brush will be readily apparent to those of ordinary skill in the art upon reading the following detailed description of the presently preferred, but nonetheless illustrative, embodiments when taken in conjunction with the accompanying drawings.

In this respect, before explaining the current embodiments of the hair brush in detail, it is to be understood that the hair brush is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the hair brush.

It is therefore important that the claims be regarded as including such equivalent construction insofar as they do not depart from the spirit and scope of the hair brush. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
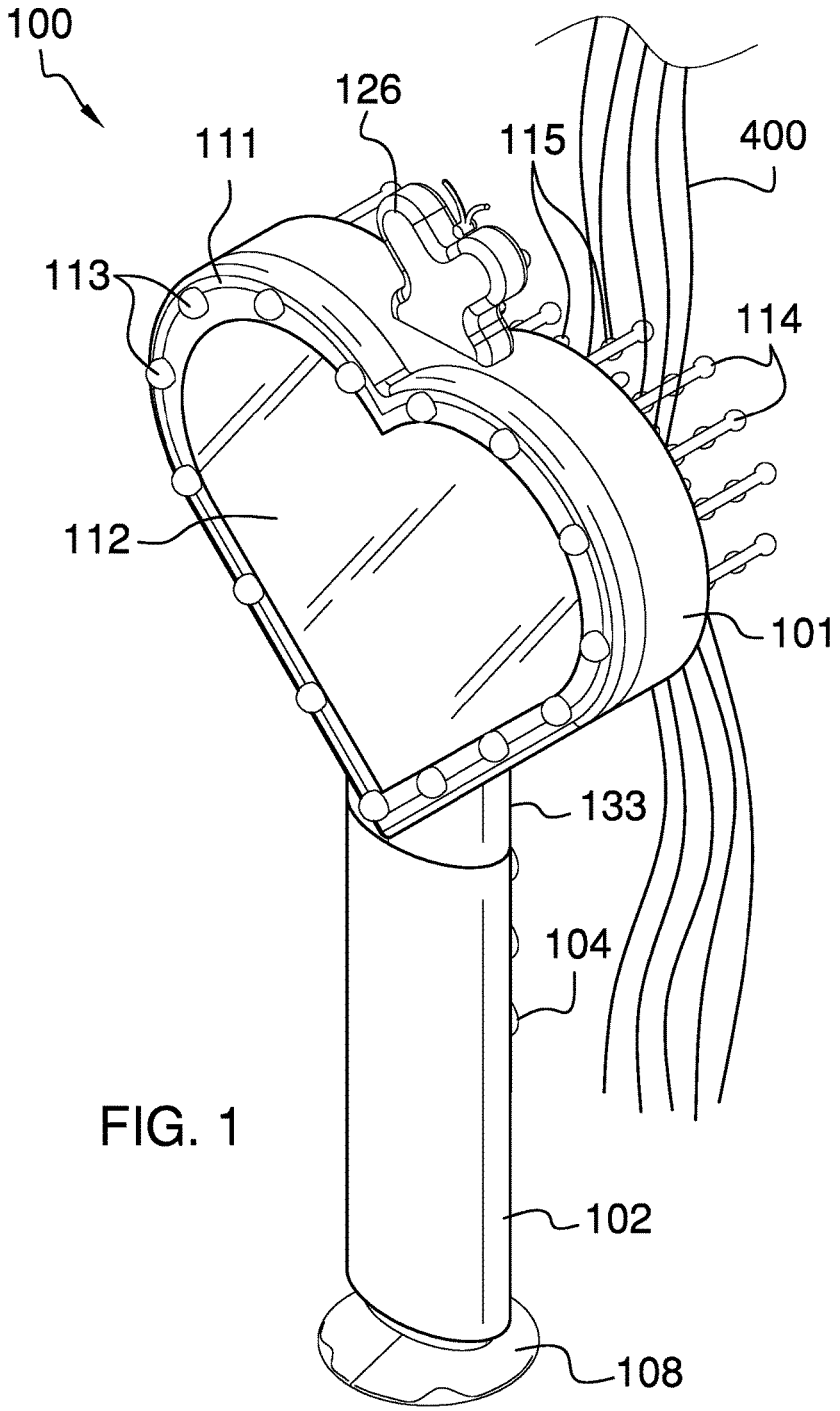
FIG. 1 is a perspective view of an embodiment of the disclosure.
Figure 2:
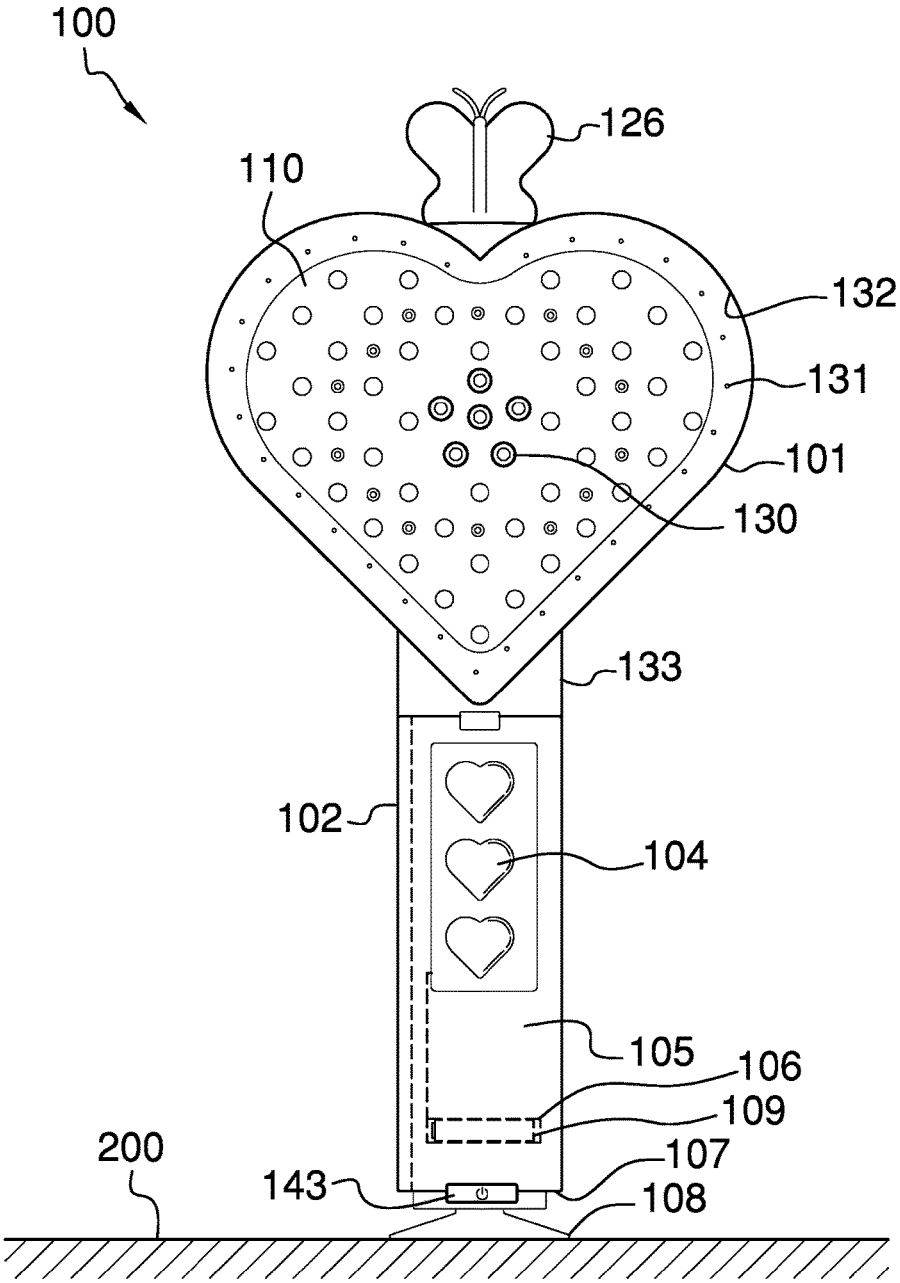
FIG. 2 is a front view of an embodiment of the disclosure.
Figure 3:
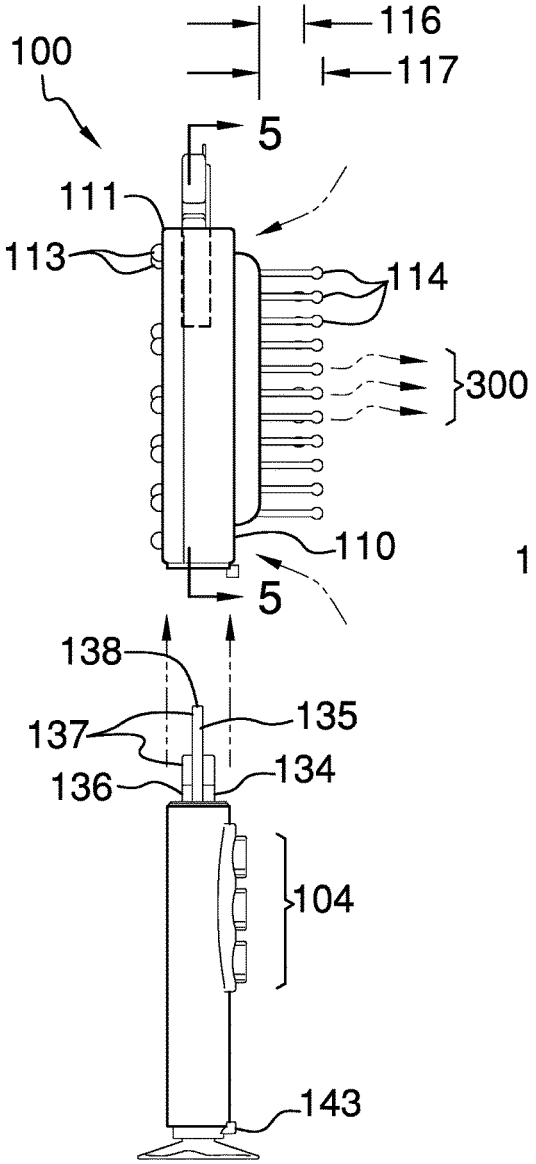
FIG. 3 is a side, exploded view of an embodiment of the disclosure.
Figure 4:
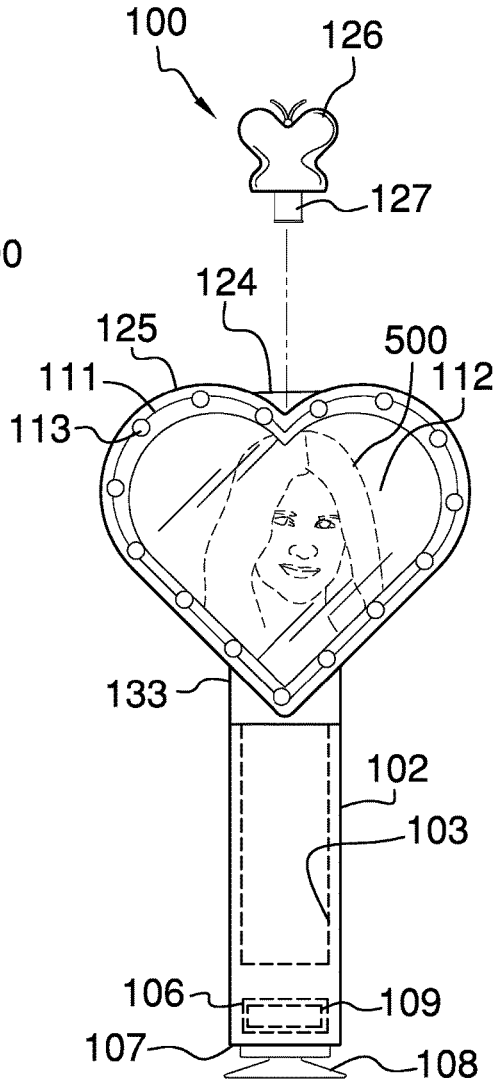
FIG. 4 is a rear view of an embodiment of the disclosure.
Figure 5:
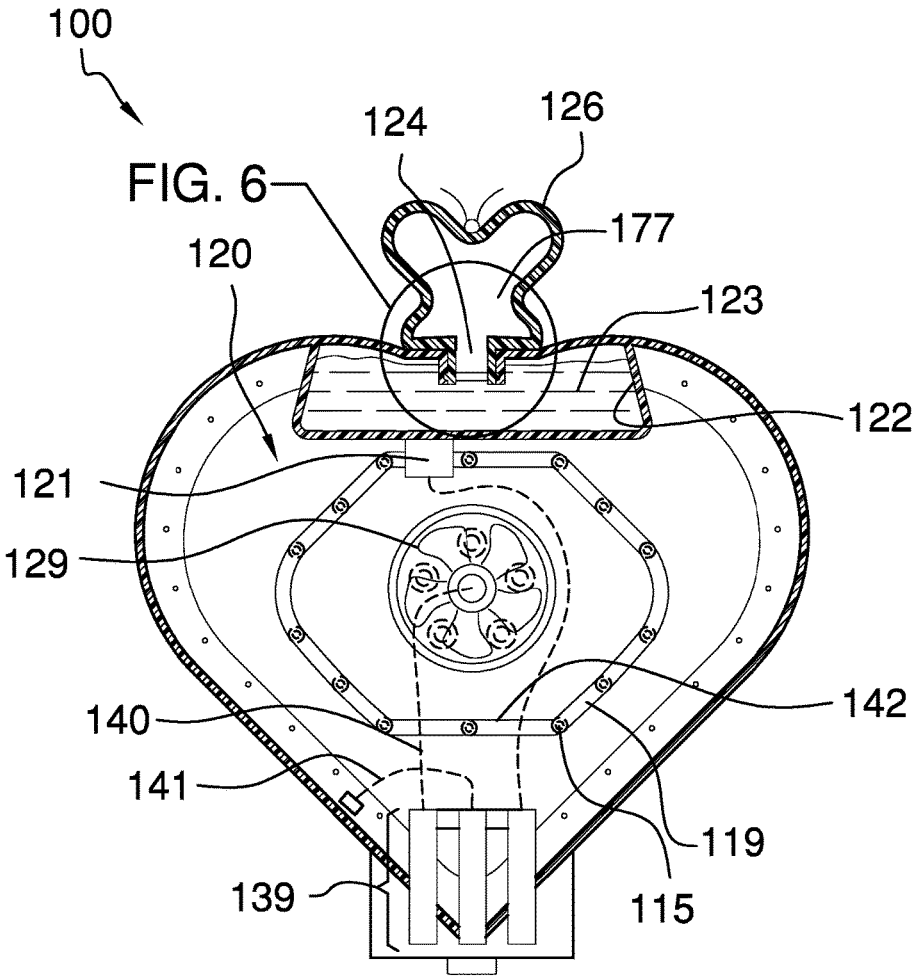
FIG. 5 is a cross-sectional view of an embodiment of the disclosure along line 5-5 in FIG. 4.
Figure 6:
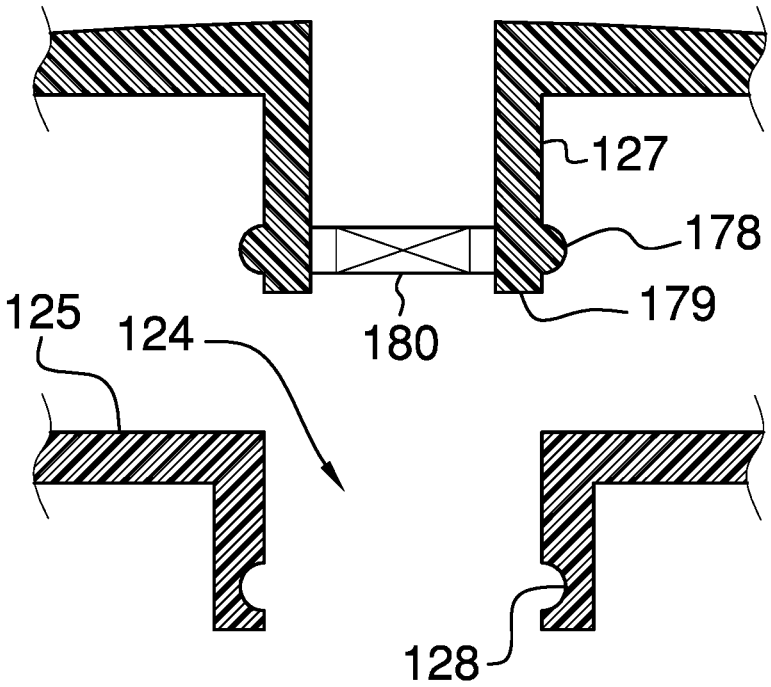
FIG. 6 is a close up detail of FIG. 5 of an embodiment of the disclosure.

Detailed reference will now be made to one or more potential embodiments of the disclosure, which are illustrated in FIGS. 1 through 6.

The hair brush 100 (hereinafter invention) comprises a brush head 101 and a handle 102. The handle 102 is able to be removed from the brush head 101. The handle 102 is removed to reveal a secret compartment 103. The handle 102 also includes control buttons 104 on a forward handle surface 105 of the handle 102. The handle 102 is also further defined with a battery compartment 106 provided adjacent to a bottom distal end 107 of the handle 102.

The bottom distal end 107 of the handle 102 includes a suction cup 108 that is configured to rigidly support the invention 100 in a vertical orientation with a support surface 200. The battery compartment 106 houses at least one battery 109 therein. The at least one battery 109 is used to provide all electrical needs of the invention 100.

The brush head 101 is further defined with a front surface 110 and a rear surface 111. The front surface 110 is opposite of the rear surface 111. The rear surface 111 includes a mirrored surface 112 thereon. The mirrored surface 112 is lined with a plurality of lights 113 that illuminate an end user 500 when looking at the mirrored surface 112. As a side note, the brush head 101, as currently depicted in the Figures, resembles a heart shape, and may be modified to take on a different shape.

The front surface 110 and the rear surface 111 are generally planar. The front surface 110 includes a plurality of brush bristles 114 that extend outwardly. The plurality of brush bristles 114 is adapted to be used to brush hair 400. The front surface 110 also includes a plurality of mist bristles 115. The plurality of mist bristles 115 are further defined with a mist length 116. The plurality of brush bristles 114 are further defined with a brush length 117. The mist length 116 is less than the brush length 117.

The plurality of mist bristles 115 is in fluid connection with a conduit 119 that is provided in an interior 120 of the brush head 101. That being said, the brush head 101 is of hollowed construction. The conduit 119 connects to a pump 121 located within the interior 120 of the brush head 101. The pump 121 is connected to a liquid reservoir 122 provided in the interior 120 of the brush head 101. The liquid reservoir 122 supplies an aqueous solution 123 that is configured to be dispensed onto the hair of an end user via the plurality of mist bristles 115.

The liquid reservoir 122 includes a refill port 124 that extends upwardly from a side surface 125 of the brush head 101. The refill port 124 is sealed via a cap 126. The cap 126 includes a male conduit 127 that extends downwardly from the cap 126. Moreover, the male conduit 127 includes an annular ring 178 adjacent a distal end 179 of the male conduit 127. The annular ring 178 interfaces with an internal groove 128 provided on the refill port 124. The liquid reservoir 122 is used to store the aqueous solution 123 that is dispensed via the plurality of mist bristles 115. It shall be noted that the aqueous solution 123 may be water, a hair care product (such as a hair detangler), or some other solution attributed with treating or styling hair.

The cap 126 is further defined with a cap reservoir 177, which is able to provide fluid communication with the liquid reservoir 122 when the cap 126 is secured onto the refill port 124 via the annular ring 178 of the male conduit 127 and the internal groove 128 of the refill port 124. The cap 126 is of hollowed construction and is able to store a portion of the aqueous solution 123. The male conduit 127 of the cap 126 may also feature a valve member 180 that restricts fluid flow from the cap 126 into the refill port 124. The valve member 180 is located adjacent to the distal end 179 of the male conduit 127.

The invention 100 includes an air dryer feature that is integrated into the construction of the brush head 101. A fan 129 is located in the interior 120 of the brush head 101. The fan 129 accelerates air 300, which is emitted via air nozzles 130 provided on the front surface 110 of the brush head 101. The accelerates air 300 exits the front surface 110 and is adapted to aid in drying hair of the end user. The brush head 101 includes air inlets 131 on the front surface 110. The air inlets 131 are provided adjacent to a perimeter edge 132 of the front surface 110. The air nozzles 130 are more centrally oriented on the front surface 110. The air nozzles 130 are condensed to a small area.

The brush head 101 includes a receptacle 133 that extends downwardly from the side surface 125. Moreover, the receptacle interfaces with handle 102. The at least one battery 109 is wired to the control buttons 104, which in turn connect to the pump 121, the fan 129, and the plurality of lights 113. A first wire 134, a second wire 135, and a third wire 136 extend from the handle 102 and each include a terminal 137 on a distal end 138. A wire connection bracket 139 is provided within the receptacle 133 of the brush head 101. The wire connection bracket 139 interfaces with the terminal 137 of the first wire 134, the second wire 135, and the third wire 136.

A fourth wire 140 extends from the wire connection bracket to the fan 129. A fifth wire 141 extends from the wire connection bracket 139 to the plurality of lights 113. A sixth wire 142 extends from the wire connection bracket 139 to the pump 121. Optionally, an on/off button 143 may be provided on the handle 102 in order to turn on or off the invention 100.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A hair brush comprising:

a brush head that is detachable with respect to a handle;

wherein the brush head includes a plurality of brush bristles that are adapted to brush hair;

wherein the brush head includes an air dryer that directs accelerated air out and is adapted to dry said hair;

wherein the brush head includes a plurality of mist bristles that dispense an aqueous solution that is adapted to interface with said hair;

wherein the brush head includes a mirrored surface.

2. The hair brush according to claim 1 wherein the handle is removable from the brush head in order to reveal a secret compartment provided within the handle.

3. The hair brush according to claim 2 wherein the handle includes control buttons on a forward handle surface of the handle.

4. The hair brush according to claim 3 wherein the handle is further defined with a battery compartment provided adjacent to a bottom distal end of the handle; wherein the battery compartment houses at least one battery therein.

5. The hair brush according to claim 4 wherein the bottom distal end of the handle includes a suction cup that is configured to rigidly support the hair brush in a vertical orientation with a support surface.

6. The hair brush according to claim 5 wherein the brush head is further defined with a front surface and a rear surface; wherein the front surface is opposite of the rear surface; wherein the rear surface includes the mirrored surface thereon.

7. The hair brush according to claim 6 wherein the mirrored surface is lined with a plurality of lights that is adapted to illuminate an end user when looking at the mirrored surface.

8. The hair brush according to claim 7 wherein the front surface and the rear surface are generally planar; wherein the front surface includes the plurality of brush bristles thereon; wherein the plurality of brush bristles extend outwardly with respect to the front surface.

9. The hair brush according to claim 8 wherein the front surface includes the plurality of mist bristles thereon; wherein the plurality of mist bristles extend outwardly with respect to the front surface.

10. The hair brush according to claim 9 wherein the plurality of mist bristles are further defined with a mist length; wherein the plurality of brush bristles are further defined with a brush length; wherein the mist length is less than the brush length.

11. The hair brush according to claim 10 wherein the brush head is of hollowed construction and is further defined with an interior; wherein the plurality of mist bristles is in fluid connection with a conduit that is provided in the interior of the brush head; wherein the conduit connects to a pump located within the interior of the brush head.

12. The hair brush according to claim 11 wherein the pump is connected to a liquid reservoir provided in the interior of the brush head; wherein the liquid reservoir stores the aqueous solution that is configured to be dispensed onto the hair via the plurality of mist bristles.

13. The hair brush according to claim 12 wherein the liquid reservoir includes a refill port that extends upwardly from a side surface of the brush head.

14. The hair brush according to claim 13 wherein the refill port is sealed via a cap; wherein the cap includes a male conduit that extends downwardly from the cap; wherein the male conduit includes an annular ring adjacent a distal end of the male conduit; wherein the annular ring interfaces with an internal groove provided on the refill port; wherein the liquid reservoir is used to store the aqueous solution that is dispensed via the plurality of mist bristles; wherein the cap is further defined with a cap reservoir, which is able to provide fluid communication with the liquid reservoir when the cap is secured onto the refill port via the annular ring of the male conduit and the internal groove of the refill port; wherein the cap is of hollowed construction and is able to store a portion of the aqueous solution; wherein the male conduit of the cap features a valve member that restricts fluid flow from the cap into the refill port; wherein the valve member is located adjacent to the distal end of the male conduit.

15. The hair brush according to claim 14 wherein a fan is located in the interior of the brush head; wherein the fan accelerates air, which is emitted via air nozzles provided on the front surface of the brush head; wherein the air exits the front surface and is adapted to aid in drying hair; wherein the brush head includes air inlets on the front surface; wherein the air inlets are provided adjacent to a perimeter edge of the front surface; wherein the air nozzles are more centrally oriented on the front surface.

16. The hair brush according to claim 15 wherein the brush head includes a receptacle that extends downwardly from the side surface; wherein the receptacle interfaces with the handle.

17. The hair brush according to claim 16 wherein the at least one battery is wired to the control buttons, which in turn connect to the pump, the fan, and the plurality of lights.

18. The hair brush according to claim 17 wherein a first wire, a second wire, and a third wire extend from the handle and each include a terminal on a distal end.

19. The hair brush according to claim 17 wherein a wire connection bracket is provided within the receptacle of the brush head; wherein the wire connection bracket interfaces with the terminal of the first wire, the second wire, and the third wire.

20. The hair brush according to claim 19 wherein a fourth wire extends from the wire connection bracket to the fan; wherein the fourth wire interfaces with the terminal of the first wire; wherein a fifth wire extends from the wire connection bracket to the plurality of lights; wherein the fifth wire interfaces with the terminal of the second wire; wherein a sixth wire extends from the wire connection bracket to the pump; wherein the sixth wire interfaces with the terminal of the third wire; wherein an on/off button is provided on the handle in order to turn on or off the electrical supply from the at least one battery to the control buttons.

* * * * *